US006558440B1

(12) United States Patent
Price, Jr.

(10) Patent No.: US 6,558,440 B1
(45) Date of Patent: May 6, 2003

(54) FIRE STARTING ASSEMBLY

(76) Inventor: John L. Price, Jr., R.D. #2, Box 195, New Bethlehem, PA (US) 16242

( * ) Notice: Subject to any disclaimer, the term of this patent is extended or adjusted under 35 U.S.C. 154(b) by 0 days.

(21) Appl. No.: 09/870,038

(22) Filed: May 30, 2001

(51) Int. Cl.[7] ..... C10L 5/00

(52) U.S. Cl. ..... 44/532; 44/533; 44/534; 44/541

(58) Field of Search ..... 44/532, 533, 534, 44/541

(56) References Cited

U.S. PATENT DOCUMENTS 642,266 A * 1/1900 Shelley ..... 44/532
4,627,854 A * 12/1986 Pratt ..... 44/541
4,762,525 A * 8/1988 Wood ..... 44/534
6,076,515 A * 6/2000 Smith ..... 126/9

* cited by examiner

*Primary Examiner*—Cephia D. Toomer
(74) *Attorney, Agent, or Firm*—Buchanan Ingersoll, P.C.

(57) ABSTRACT

A fire starting assembly is provided in accordance with the present invention for easily lighting and maintaining a fire in an outdoor environment. The inventive fire starting assembly includes, in its simplest form, a combustible container defining an interior, and intermixed layers of flammable and combustible materials in the container interior having first and second burning points, respectively. To provide oxygen for the fire, the container includes holes for admitting air into the container interior, thus fueling the fire within the container interior.

10 Claims, 2 Drawing Sheets

FIRE STARTING ASSEMBLY

FIELD OF THE INVENTION

The present invention is directed generally toward fire starting assemblies and, more particularly, toward a portable fire starting assembly having easy lighting and long burning characteristics.

BACKGROUND OF THE INVENTION

Outdoor recreational activities are common in today's society. Such outdoor recreational activities include activities such as camping, fishing, hunting, sledding, and virtually any other activity that can be performed outdoors. Various of these activities, e.g., sledding, are not performed during the summer months when the weather is warm. Many individuals engage in such outdoor activities when the outdoor temperature is on the colder side. For example, the rifle deer season in the Commonwealth of Pennsylvania typically occurs from late November to mid-December. At such times, the outdoor temperature can be fairly cold, potentially reaching frigid temperatures with and without factoring in wind chill. Also, the opening day of trout season in the Commonwealth of Pennsylvania typically occurs in mid-April. At this time, the weather is often on the colder side, requiring individuals to take appropriate precautions to keep themselves warm. Even during the summer months, the temperature at night may drop considerably from the temperature during the daylight hours. This is especially true in the mountainous areas of the country where individuals typically go camping.

Many individuals engaging in outdoor activities in the colder months of the year will be become just that, cold. Unless these individuals can find a way to warm themselves, even if only for a short period of time, the fact that they are cold may cause them to cut short the outdoor activity in which they are engaging. At such times, many individuals desire to light a fire, such as a campfire, to warm themselves. However, campfires are fairly difficult to light, requiring an individual to take the time to gather wood and kindling, and also requires the individual to have on their person, or readily available, a flammable starting material in order to get the fire started. Further, simply gathering wood and kindling in general is not enough to build a campfire, as the wood and kindling must be sufficiently dry in order to burn properly. Since an individual by this time is normally already cold, he or she may not wish to take the time to search for and gather sufficiently dry wood and kindling, and simply forego in continuing to engage in the particular outdoor activity.

Even after searching for and gathering sufficiently dry burning materials, an individual may find it difficult or impossible to start a campfire due to windy conditions. The wind may continue to extinguish the fire before it has a chance to sufficiently burn and "catch". Thus, even though an individual has taken the time to gather the appropriate wood, kindling, etc., a windy day may simply prevent the individual from being able to light a fire for warmth. This can be particularly frustrating and, when faced with such problems, often cause an individual to simply quit the outdoor activity and return to a car, house, etc., where heat is available.

The present invention is directed toward overcoming one or more of the above-mentioned problems.

SUMMARY OF THE INVENTION

A fire starting assembly is provided in accordance with the present invention for easily lighting and maintaining a fire in an outdoor environment. The inventive fire starting assembly includes, in its simplest form, a combustible container defining an interior, and intermixed layers of flammable and combustible materials in the container interior having first and second burning points, respectively. To provide oxygen for the fire, the container includes holes for admitting air into the container interior, thus fueling the fire within the container interior.

The first burning point of the flammable material is at a temperature less than the second burning point of the combustible material. The combustible container typically has a third burning point at a temperature between the first and second burning points.

In a preferred form, the combustible container includes a cardboard box having top, bottom and side surfaces, the flammable material includes shredded paper, and the combustible material includes elongate pieces of wood. The intermixed layers accordingly include intermixed layers of shredded paper and pieces of wood. The pieces of wood in each respective wood layer are preferably spaced from one another, with the shredded paper additionally provided in the spaces between the pieces of wood in the wood layers.

In one form, the elongate pieces of wood include spaced first and second ends, with the elongate pieces of wood oriented vertically in the container interior such that their first and second ends lie generally adjacent the container top and bottom surfaces, respectively.

In another form, the elongate pieces of wood are oriented in row and column format within the container interior, such that adjacent members in each row are spaced from one another and adjacent members in each column are spaced from one another.

In a further form, the shredded paper defines pores formed in between, and by, the shredded paper material, with the pores permitting air to flow therethrough for fueling the fire within the container interior.

It is an object of the present invention to provide a fire starting assembly that is easy to light and long burning.

It is an additional object of the present invention to provide a fire starting assembly that is easy to light in windy conditions.

It is a further object of the present invention to provide a fire starting assembly that is easily transportable.

It is yet a further object of the present invention to provide a fire starting assembly made completely of burnable material.

It is still a further object of the present invention to provide a fire starting assembly that gives off enough heat such that it may be utilized as a fire in and of itself.

Other objects, aspects and advantages of the present invention can be obtained from a study of the specification, the drawings, and the appended claims.

DETAILED DESCRIPTION OF THE INVENTION

Figure 1:
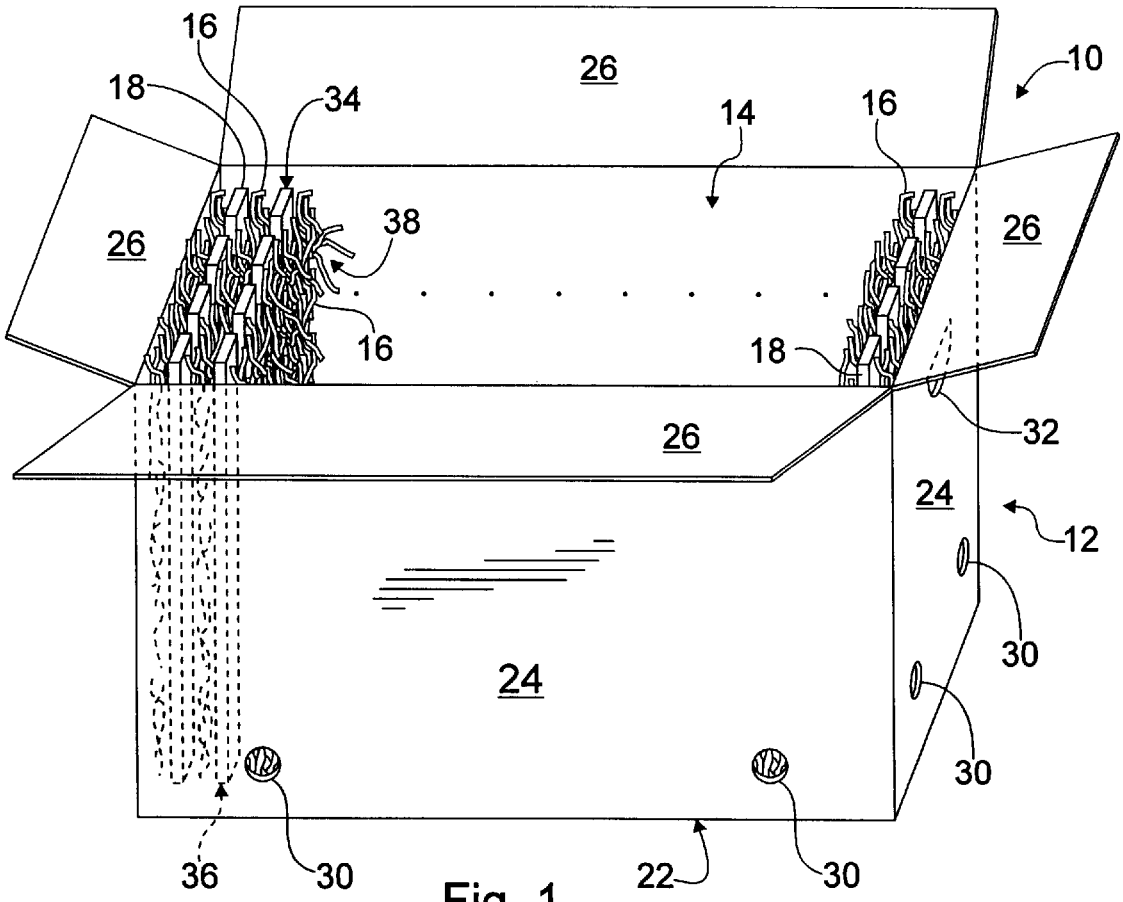
FIG. 1 is a perspective view of a fire starting assembly according to the present invention in an open position.

Referring to FIG. 1, a fire starting assembly according to the present invention is shown generally at 10. The fire starting assembly 10, in its simplest form, includes a combustible container 12 defining an interior 14, with a flammable material 16 generally filling the container interior 14 and having a plurality of combustible members, or material 18, intermittently dispersed in the flammable material 16 in the container interior 14. As shown in FIG. 1, the flammable 16 and combustible 18 materials are provided in intermixed layers within the container interior 14.

The combustible container 12, the flammable material 16 and the combustible members 18 are all made from burnable material. In order to facilitate lighting and burning of the fire starting assembly 10, the flammable material 16 includes an easy ignitable material having a burning point at a relatively low temperature. The combustible container 12 is made of a material that is longer burning than the flammable material 16, and has burning point at a temperature higher than the burning point temperature of the flammable material 16. The combustible members 18 are made of a material that is even longer burning than the combustible container 12, and each has a burning point at a temperature higher than that of the burning point temperatures of either the combustible container 12 or the flammable material 16. In a preferred form, the combustible container 12 includes a cardboard box, the flammable material 16 includes shredded paper, and the combustible members 18 includes pieces of wood, and these elements will hereinafter be referred to as such. However, it should be understood that other burnable materials having appropriately related burning point temperatures for at least the flammable 16 and combustible 18 materials may be implemented without departing from the spirit and scope of the present invention.

Figure 2:
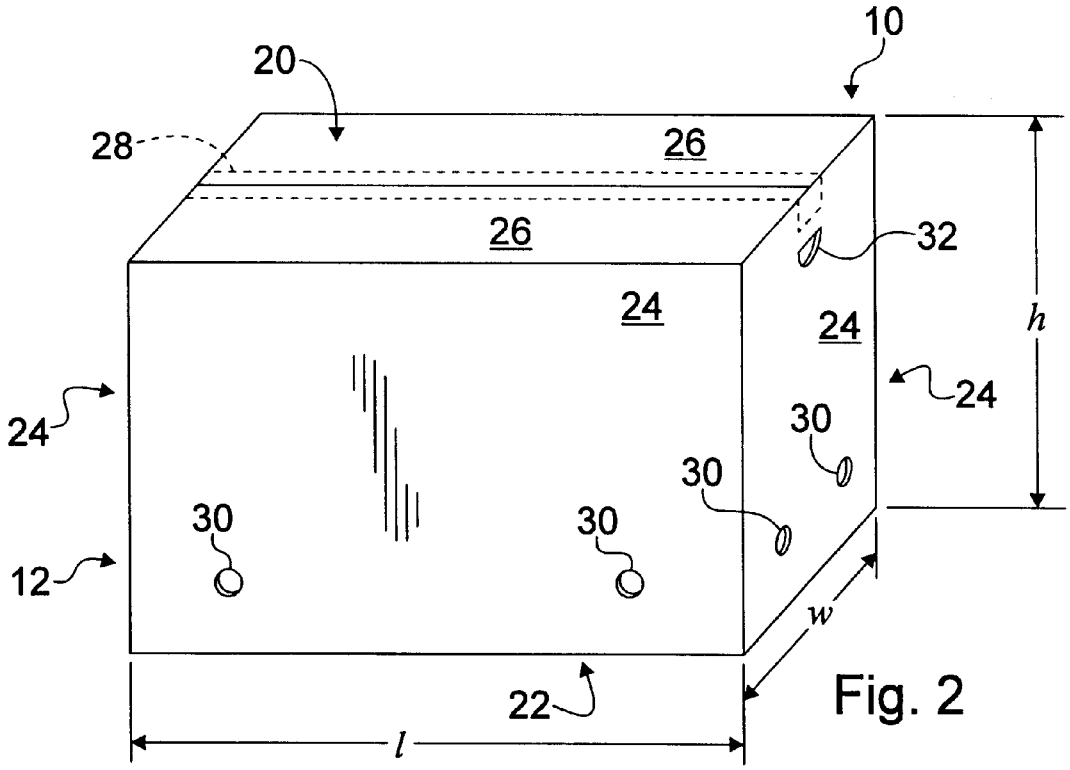
FIG. 2 is a perspective view of the fire starting assembly according to the present invention in a closed position.

Referring to FIGS. 1–2, the cardboard box 12 is preferably rectilinear in shape, having top 20, bottom 22, and four side surfaces 24. To facilitate opening of the cardboard box 12 for lighting purposes, the top surface 20 is defined by flaps 26 which may be folded as shown in FIG. 2 to define the top surface 20, thus closing the cardboard box 12. To maintain closure of the cardboard box 12, a strip of tape 28, or other adhesive means, may be provided along the top surface 20 along the seam formed by the closed flaps 26. The tape 28, or other adhesive means, should maintain the cardboard box 12 in a closed position, but be removable so that the flaps 26 may be opened for lighting of the fire starting assembly 10.

To facilitate burning of the shredded paper 16 and the wood pieces 18 within the container interior 14, air holes 30 are provided in the side surfaces 24. Preferably, the air holes 30 are approximately 1.25" in diameter, with two air holes 30 formed in each of the side surfaces 24 generally near the bottom surface 22. However, any number of air holes 30 having virtually any diameter may be formed in the fire starting assembly 10 in any of the surfaces 20, 22 or 24 without departing from the spirit and scope of the present invention. To facilitate carrying of the fire starting assembly 10 to a remote location, handles 32 are provided in opposing side surfaces 24. Preferably, the handles 32 typically include cut-out handles formed in the opposing side surfaces 24, however, other handle configurations may be implemented.

Figure 3:
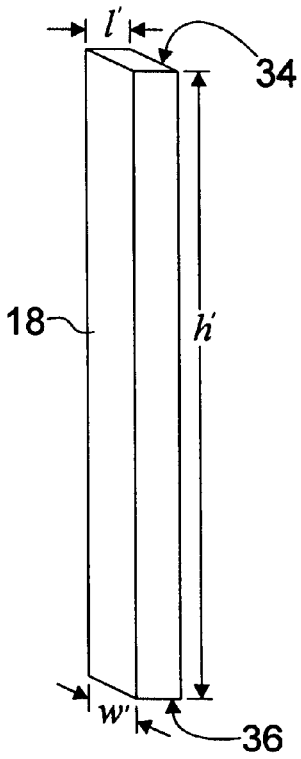
FIG. 3 is a perspective view of a combustible member incorporated within the inventive fire starting assembly.

As shown in FIGS. 1 and 3, the pieces of wood 18 are preferably elongate, having first 34 and second 36 spaced ends. The wood pieces 18 are intermittently disposed in the container interior 14, such that a space is provided around each of the wood pieces 18. As shown in FIG. 1, the wood pieces 18 are preferably oriented in row and column format within the container interior 14, such that adjacent wood pieces 18 in each row are spaced from one another, and adjacent wood pieces 18 in each column are spaced from one another. The wood pieces 18 are preferably vertically oriented, such that the first end 34 of the wood pieces 18 lies generally adjacent the top surface 20 of the cardboard box 12, and the second end 36 of the wood pieces 18 lies generally adjacent the bottom surface 22 of the cardboard box 12. The shredded paper 16 fills the remainder of the container interior 14 completely surrounding each of the wood pieces 18. It should be understood that the orientation shown in FIG. 1 is a preferred embodiment only, and the wood pieces 18 may be sized, dispersed and/or oriented in the container interior 14 randomly or in any other manner without departing from the spirit and scope of the present invention.

Figure 4:
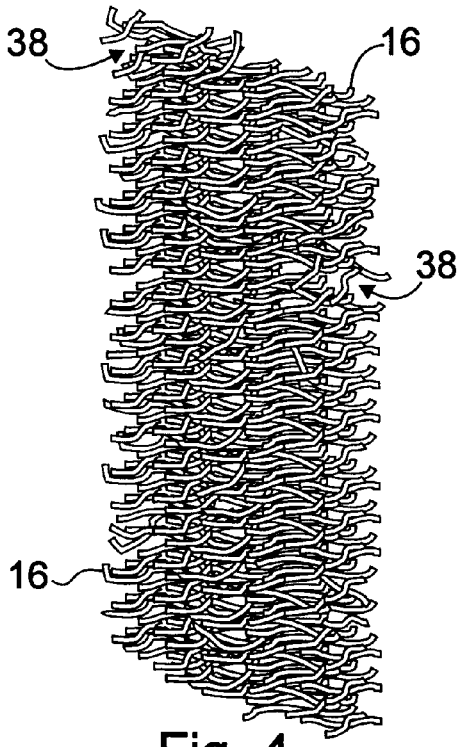
FIG. 4 illustrates a flammable material incorporated within the inventive fire starting assembly.

As shown in FIGS. 1 and 4, the shredded paper 16 defines pores 38 which are formed between, and by, the paper material. The pores 38 permit air to flow between the paper material, thus providing oxygen to the fire started and burning within the container interior 14.

In operation, a user simply opens the flaps 26 of the top surface 20 to the position shown in FIG. 1. Since the shredded paper 16 is a highly flammable material having a low burning point, upon touching a match or other lighting element to the shredded paper 16 it will almost immediately begin to burn. The user may then close the flaps 26 to the position shown in FIG. 2, to prevent wind from blowing out the fire which has been started within the container interior 14. Oxygen is provided to the fire started and burning in the container interior 14 via the air holes 30 formed in the side surfaces 24 and the pores 38 defined by the shredded paper 16. As the shredded paper 16 within the container interior 14 catches fire, it burns all around each of the wood pieces 18, eventually heating the wood pieces 18, to a burning point such that the wood pieces 18, will ignite and begin to burn. Since the cardboard box 12 is also burnable, it will also catch fire, typically before the wood pieces 18 and will help to ignite the wood pieces 18. Thus, simply by touching a match to the shredded paper 16, a user can have a small fire readily before them in a matter of minutes, with little or no clean-up since all of the material included in the fire starting assembly 10 is burnable.

The fire starting assembly 10 can be used in a variety of outdoor activities, such as, but not limited to, camping, fishing along a lake or stream, hunting, sledding, working outdoors, or any outdoor activity in general. Preferably, as shown in FIG. 2, the cardboard box 12 has a length 1 equal to 14", a width w equal to 14", and a height h equal to 12". With this particular size, the fire starting assembly 10 may be easily transportable to a variety of outdoor locations. Also, as shown in FIG. 3, the wood pieces 18 preferably have a height h' equal to 11.5", a width w' ranging from 0.5"–2.0", and a length 1' between 0.5"–2.0". Preferably, the wood pieces 18 have a square 1'×w' cross-section, however, the present invention is not limited thereto. It will be appreciated that the smaller cross-sectional wood pieces 18 will "catch" and burn faster, while the larger cross-sectional wood pieces 18, will "catch" and burn at a slower rate. Since the wood pieces 18 will be standing upright in the cardboard box 12, there is room to place shredded paper 16 both below and on top of the wood pieces 18 in the container interior 14. It should be understood that the above-recited dimensions of the cardboard box 12 and the wood pieces 18 are for exemplary purposes only to provide a fire starting assembly that is sufficiently light-weight to be readily transportable; any dimensions may be utilized without departing from the spirit and scope of the present invention.

The size of the cardboard box 12 and the wood pieces 18 will dictate the number of wood pieces 18 that may be positioned within the container interior 14. Sufficient shredded paper 16, or other flammable material, should be positioned in the container interior 14 surrounding the wood pieces 18 such that sufficient heat will be generated by the burning of the shredded paper 16 to ignite the wood pieces 18. Testing was performed on a number of samples made in accordance with the above-recited dimensions, and each time the fire and heat generated by the fire starting assembly 10 lasted approximately 35–40 minutes without adding wood to the fire. Thus, the fire starting assembly 10 according to the present invention acts as a campfire in and of itself generating sufficient heat to temporarily warm individuals from the cold. Once the fire starting assembly 10 has been ignited and is readily burning, a user can easily add wood or other burnable material to the fire and keep it going for as long as it the user desires.

Virtually any type of wood, or combustible material, may be implemented for the wood pieces 18, including, but not limited to, wood types such has pine, oak, cherry, poplar, maple, walnut, etc. Further, compressed particle board pieces may be utilized, and the wood pieces 18 may or may not include bark on the outer surfaces thereof. Still further, other combustible materials, such as, but not limited to, charcoal pieces, may be utilized in conjunction with, or in place of, the wood pieces 18 if so desired without departing from the spirit and scope of the present invention.

Similarly, any type of paper product or other flammable material having a sufficient burning point may be utilized in place of, or in conjunction with, the shredded paper 16 without departing from the spirit and scope of the present invention. For example, wood chips, saw dust, burnable wax-type material, etc., may be added to the shredded paper 16 for burning purposes. The only requirement being that the material utilized in place of the shredded paper 16 be easily ignitable in order to start the fire within the container interior 14. Similarly, the wood pieces 18 may be provided with a flammable wax material to aid in the ignition process. Still further, a flammable accelerate may be provided in the container interior 14 to aid in ignition and burning.

If desired, advertising media may be printed on the side surfaces 24 of the cardboard box 12, providing a non-exhaustive list of uses the fire starting assembly 10, or simply for decorative purposes.

While the present invention has been described with particular reference to the drawings, it should be understood that various modifications could be made without departing from the spirit and scope of the present invention.

I claim:

1. A fire starting assembly comprising:

a combustible container defining an interior;

a flammable material generally filling the container interior and having a first burning point, wherein the flammable material is selected from the group consisting of paper products, wood chips, sawdust, burnable wax material and mixtures thereof; and a plurality of combustible members intermittently dispersed in the flammable material in the container interior and having a second burning point at a temperature greater than the first burning point, wherein the plurality of combustible members are selected from the group consisting of wood pieces, compressed particle board pieces, charcoal pieces and mixtures thereof.

2. The fire starting assembly of claim 1, wherein the container includes holes for admitting air into the container interior.

3. The fire starting assembly of claim 1, wherein the combustible container includes top, bottom and side surfaces, wherein the plurality of combustible members include a plurality of elongate combustible members having spaced first and second ends, and wherein the elongate combustible members are oriented in the container interior such that their first and second ends lie generally adjacent the container top and bottom surfaces, respectively.

4. The fire starting assembly of claim 3, wherein the elongate combustible members are oriented in row and column format within the container interior, such that adjacent members in each row are spaced from one another and adjacent members in each column are spaced from one another.

5. The fire starting assembly of claim 1, wherein the combustible container has a third burning point at a temperature between the first and second burning points.

6. The fire starting assembly of claim 1, wherein the combustible container comprises a cardboard box.

7. The fire starting assembly of claim 1, wherein the flammable material comprises shredded paper.

8. A fire starting assembly comprising:

a combustible container having top, bottom and side surfaces defining an interior;

a plurality of elongate combustible members intermittently dispersed in the container interior and spaced from one another, the plurality of elongate combustible members having a first burning point, wherein the plurality of elongate combustible members are selected from the group consisting of wood pieces, compressed particle board pieces, charcoal pieces and mixtures thereof; and a porous flammable material generally filling the container interior and substantially surrounding the plurality of combustible members and having a second burning point at a temperature less than the first burning point, wherein the porous flammable material is selected from the group consisting of paper products, wood chips, sawdust, burnable wax material and mixtures thereof, and wherein the container includes at least one hole formed in at least one side surface for admitting air into the container interior.

9. The fire starting assembly of claim 8, wherein the combustible container has a third burning point at a temperature between the first and second burning points.

10. The fire starting assembly of claim 8, wherein the combustible container comprises a cardboard box, the plurality of elongate combustible members comprise pieces of wood having spaced first and second ends oriented in the container interior such that their first and second ends lie generally adjacent the container top and bottom surfaces, and the porous flammable material comprises shredded paper.

* * * * *